US007320652B2

(12) United States Patent
Kilpatrick

(10) Patent No.: US 7,320,652 B2
(45) Date of Patent: Jan. 22, 2008

(54) BASKETBALL GOAL SYSTEMS

(75) Inventor: Bryan Kilpatrick, Cumming, GA (US)

(73) Assignee: Argent Enterprises, Cumming, GA (US)

( * ) Notice: Subject to any disclaimer, the term of this patent is extended or adjusted under 35 U.S.C. 154(b) by 229 days.

(21) Appl. No.: 11/238,268

(22) Filed: Sep. 29, 2005

(65) Prior Publication Data

US 2006/0116225 A1 Jun. 1, 2006

Related U.S. Application Data

(60) Provisional application No. 60/632,395, filed on Dec. 1, 2004.

(51) Int. Cl.
*A63B 63/08* (2006.01)

(52) U.S. Cl. ..... 473/483; D21/702

(58) Field of Classification Search ..... 473/481, 473/483–484, 476; 273/400
See application file for complete search history.

(56) References Cited

U.S. PATENT DOCUMENTS

| | | | | | |
|---|---|---|---|---|---|
| 3,881,724 | A * | 5/1975 | Beveridge | 473/472 |
| 4,895,365 | A * | 1/1990 | Schroeder | 473/481 |
| 5,114,141 | A | 5/1992 | Mahoney | 273/1.5 R |
| 5,133,547 | A * | 7/1992 | Pardi | 473/484 |
| 5,211,393 | A | 5/1993 | Rolffs et al. | 273/1.5 R |
| 5,540,429 | A * | 7/1996 | Dalebout et al. | 473/483 |
| 5,573,238 | A * | 11/1996 | Aaron et al. | 473/483 |
| 5,695,417 | A | 12/1997 | Winter et al. | 473/484 |
| 5,879,247 | A | 3/1999 | Winter et al. | 473/484 |
| 6,077,177 | A | 6/2000 | Winter et al. | 473/484 |
| 6,120,396 | A | 9/2000 | Van Nimwegen et al. | 473/484 |
| 6,135,901 | A | 10/2000 | van Nimwegen | 473/484 |
| 6,142,891 | A | 11/2000 | Winter et al. | 473/484 |
| 6,155,938 | A | 12/2000 | Mower | 473/484 |
| 6,273,834 | B1 | 8/2001 | Winter | 473/484 |
| 6,302,811 | B1 * | 10/2001 | Topham | 473/484 |
| 6,419,597 | B1 | 7/2002 | van Nimwegen et al. | 473/484 |
| 6,419,598 | B1 | 7/2002 | Winter et al. | 473/484 |
| 6,422,957 | B1 | 7/2002 | Winter et al. | 473/484 |
| 6,699,146 | B1 | 3/2004 | Winter et al. | 473/484 |
| 6,837,810 | B1 * | 1/2005 | McAllister et al. | 473/483 |
| 6,848,661 | B2 * | 2/2005 | Baldasari | 248/218.4 |
| 2004/0018900 | A1 | 1/2004 | Monsen | 473/481 |
| 2006/0116225 | A1 * | 6/2006 | Kilpatrick | 473/483 |

OTHER PUBLICATIONS http://basketballgoals.com/displayProduct.asp?productID=2426.
http://www.basketballstandard.com/?OVRAW=basketball%20goals&OVKEY=basketball%20goal&OVMTC=standard.

* cited by examiner

*Primary Examiner*—Eugene Kim
*Assistant Examiner*—M. Chambers
(74) *Attorney, Agent, or Firm*—Thomas, Kayden, Horstemeyer & Risley, LLP

(57) ABSTRACT

Disclosed herein are various embodiments of basketball goal systems. One embodiment, among others, comprises a rim connection assembly coupled to a support structure, the rim connection assembly comprising a support plate coupled to a backboard frame, a rim, and a plurality of tubular members through which portions of the rim are inserted and from which the rim is secured to the support plate, wherein the plurality of tubular members are configured to maintain a gap between the goal rim and a substrate corresponding to the backboard frame.

1 Claim, 16 Drawing Sheets

BASKETBALL GOAL SYSTEMS

CROSS-REFERENCE TO RELATED APPLICATION

This application claims priority to now abandoned U.S. provisional application entitled, "BASKETBALL GOAL SYSTEMS AND METHODS," having Ser. No. 60/632,395, filed Dec. 1, 2004, which is entirely incorporated herein by reference.

FIELD OF THE INVENTION

The present disclosure relates generally to basketball equipment, and more particularly, to basketball goal systems.

BACKGROUND

As the popularity of basketball has continued to increase, so has the availability of a diverse selection of basketball goals. Gone are the days of plywood nailed to the side of a garage, wherein a rusty metal rim and a chain-link net often completed the goal. Backboard options are now plentiful, ranging from inexpensive molded, opaque plastic versions to higher end acrylic or tempered glass models. Lighted rims and other specialty items are also available to enable specialized and uniquely stylized goal configurations.

In addition to backboard and rim developments, advances have continued with respect to the design of the main upright support pole and the configuration of the attachment of the backboard thereto. At least some reconfigurations of the support pole connections aesthetically improved the view through acrylic backboards, while some others have been directed toward strengthening the rim support. Other changes to the upright support pole have focused on facilitating backboard height adjustment mechanisms.

Numerous systems enable adjustment of backboard and goal height relative to the player. One simply constructed version provides a series of selectable backboard mounting apertures, thereby enabling mounting of the backboard at a first particular height, and subsequent re-mounting of the backboard at a second, or different height. While such a system does enable a basketball goal to "grow" with a child, it requires generally complete disassembly in order to adjust the height, and is thus disadvantageous for gyms, arenas or home courts where children and/or adults of varying heights and/or skills interactively play.

Other more sophisticated adjustable height versions enable adjustment without removal of the backboard, wherein on-board mechanisms are provided about or within the main support pole. Some such mechanisms manipulate the height of the pole, and thus indirectly influence the height of the backboard by changing the height of the pole. Other mechanisms involve manipulation of a backboard support arm or arms about a pivot point. Unfortunately, the design of some pivot-type adjustable goals disadvantageously results in often a significant non-standardized overhang at some heights, preventing use in some environments. That is, the distance between the main support pole and the backboard is not constant or substantially constant, and thus the standard high school, college and professional basketball dimensional requirement of four feet (4') for the overhang is not maintained for all goal heights. Still other designs disadvantageously limit the range of adjustability.

Some pivot-type adjustable goals are disadvantageous because backboard support is limited to a single arm connected behind the rim. Although such designs can potentially increase direct support of the rim, which can be advantageous during aggressive play, single arm support designs disadvantageously allow potentially damaging backboard torque. Unchecked backboard torque can lead to goal breakage, and possible player injuries as a result thereof.

In an effort to limit backboard torque, some pivot-type adjustable height designs provide for two support arms, defining a V-shape support structure, and others provide four support arms, wherein each arm is secured to the backboard, thereby defining a parallelogram configuration. Although such designs can be beneficial for counteracting backboard torque, additional improvements are still needed to ensure more durability.

SUMMARY

Embodiments of basketball goal systems are disclosed. One embodiment, among others, comprises a rim connection assembly coupled to a support structure, the rim connection assembly comprising a support plate coupled to a backboard frame, a rim, and a plurality of tubular members through which portions of the rim are inserted and from which the rim is secured to the support plate, wherein the plurality of tubular members are configured to maintain a gap between the goal rim and a substrate corresponding to the backboard frame.

Other systems, features, and advantages of the disclosed systems will be or become apparent to one with skill in the art upon examination of the following drawings and detailed description. It is intended that all such additional systems, features, and advantages be included within this description and be within the scope of the disclosure.

BRIEF DESCRIPTION OF THE DRAWINGS

The components in the drawings are not necessarily to scale, emphasis instead being placed upon clearly illustrating the principles of the disclosed systems. Moreover, in the drawings, like reference numerals designate corresponding parts throughout the several views.

DETAILED DESCRIPTION OF THE PREFERRED EMBODIMENTS

Figure 1:
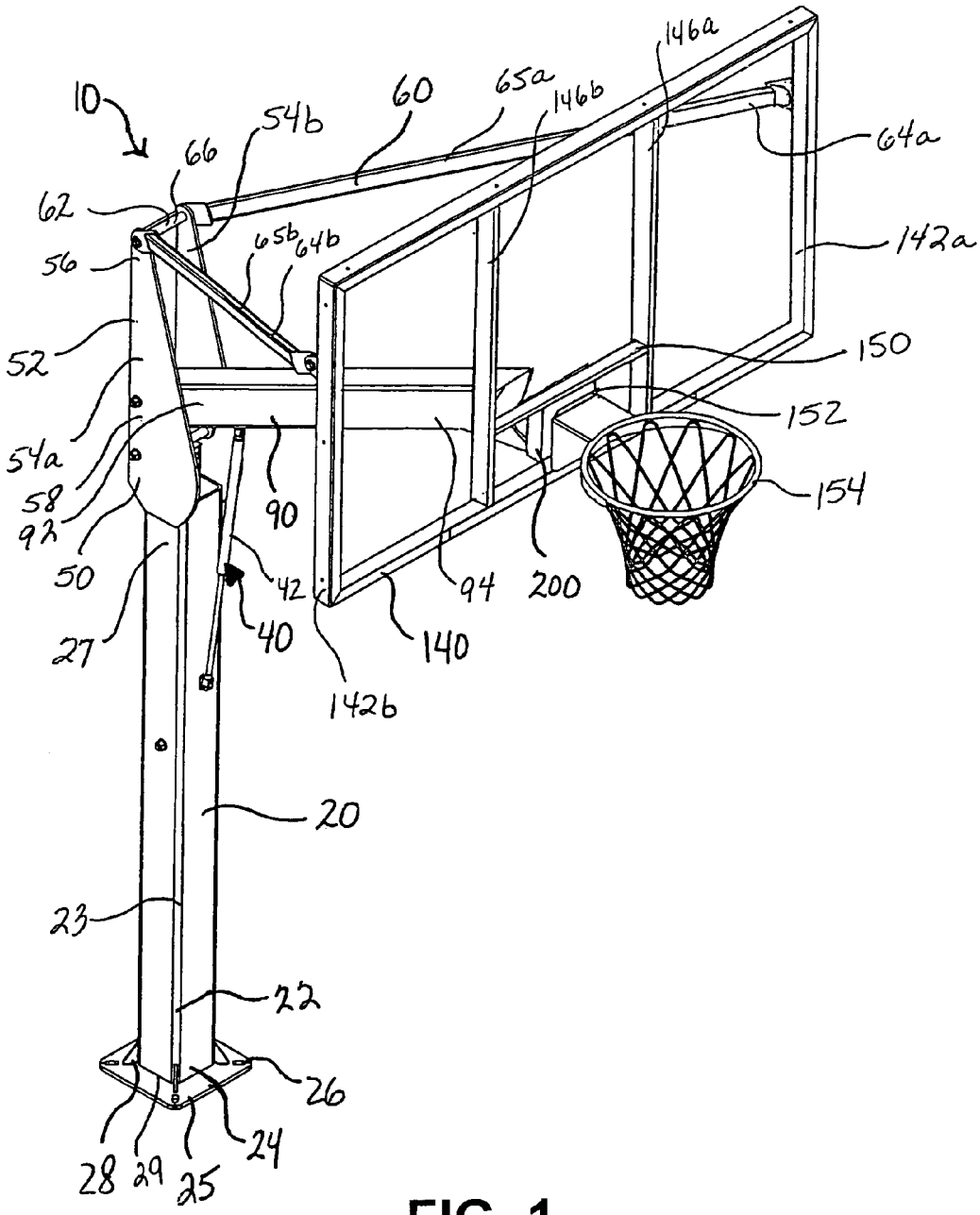
FIG. 1 is a front perspective view of an embodiment of a basketball goal system.

Disclosed herein are various embodiments of basketball goal systems. One embodiment comprises a basketball goal having a height that may be easily and quickly adjusted according to a maximized range of desirable dimensional specifications, wherein the backboard is supported by three elongated members including a lower centrally secured member and two upper peripherally secured members, wherein the two upper members define a "V"-shape and the profile defined by the three elongated members is a parallelogram, and wherein the frame for the backboard provides a protective rim connection assembly and an internal structural configuration to distribute forces across the backboard, and away from the rim connection, and to the main support pole. Unlike conventional systems which transfer the majority of the loads to the rim or support arms, the rim connection assembly, lower centrally secured member, and the parallelogram configuration enables loads imposed on the basketball rim to be transferred predominantly to a support plate as part of the rim connection assembly and then to the main support pole, preventing damage to the rim or support arms under loads. For instance, load distribution may comprise approximately 10% of the forces distributed to the backboard and approximately 90% of the forces distributed to the main support pole.

One or more embodiments of the basketball goal systems described herein may comprise a backboard and rim connection assembly that may provide enhanced strength, durability and torque control, and wherein an adjustment mechanism in and associated with the main support pole enables quick and easy backboard and goal height manipulation relative to the ground.

One embodiment of a basketball goal system comprises a main support pole that includes a height adjustment mechanism for easy raising and lowering of the backboard, and wherein manipulation of a removable crank facilitates rapid adjustment between maximum and minimum goal heights (e.g., five and one half feet (5.5') to ten feet (10')). The base of the main support pole is secured in an installed position via a mounting base plate capable of accommodating a plurality of known mounting configurations. A support member is positioned proximate to the upper end of the main support pole. In one embodiment, the support member may function as a connector bracket (or simply, bracket) between the main support pole and the backboard support arms. The teardrop profile of the supportive connector bracket facilitates placement of the bolts that secure the backboard support arms in an elevated manner, whereby the achievable range of height adjustment of the backboard is maximized and height adjustment can occur without deviation, or without significant deviation, from the standard four-foot (4') overhang. Such a consistent, standardized overhang feature at any height may enable use in standard high school, college and professional basketball arenas.

The backboard support arms may be pivotally secured at the supportive connector bracket, supported by the main support pole. Two upper support arms define a "V"-shape, wherein the vertex may be positioned, in one embodiment, proximate the upper end of the supportive connector bracket, and wherein the distal end of each upper support arm is pivotally secured to the upper half of the backboard frame, proximate the peripheral side edges, thereby reducing torque and providing a true, solid rebound with minimized vibration. The lower support arm is positioned proximate the lower end of the supportive connector bracket and the upper end of the main support pole, with the distal end of the lower support arm pivotally positioned proximate the rim connection assembly. On profile, the two upper support arms may be positioned substantially parallel with the lower support arm, wherein the relative positions remain essentially constant irrespective of goal height adjustment. The lower support arm may be pivotally adjusted via the height adjustment mechanism, wherein the pivotal adjustment of the upper support arms is in response thereto.

In another embodiment, among others, the backboard support arms may be pivotally secured to the lower support arm with a relative position of upper and lower support arms upon adjustment of backboard height more variable than the aforementioned embodiment.

A frame for the backboard includes an essentially continuous peripheral edge, two vertical support members extending between the upper and lower peripheral edges, and a horizontal support member extending between the two vertical support members, proximate the connection point for the rim. Such an arrangement may enhance the view through acrylic and/or glass-based backboards. A support plate is secured to the frame, wherein a plurality of generally tubular-shaped members are provided, extending outwardly from the support plate, thereby enabling the rim to be fastened to the backboard without compromising the glass or acrylic of the backboard. In other words, this arrangement may facilitate secure installation of the rim to the frame of the backboard, essentially without coming into contact with the backboard substrate, such as acrylic or glass. Accordingly, the support-plate attachment mechanism and the vertical support members act to transfer tension resulting from aggressive play, or slam-dunks, to a plurality of locations about the frame, and the lower support arm acts to transfer stresses (e.g., 90%) predominantly to the main support pole, thus preventing localized stress and backboard breakage, reducing rim distortion from heavy loads, and generally providing for a robust assembly.

In one embodiment, the lower support arm is height adjustable via a height adjustment mechanism, wherein a screw jack is positioned within the main support pole proximate the lower support arm and an adjustment cylinder (e.g., gas strut) is secured between the main support pole and the lower support arm. The adjustment cylinder has an additional benefit of acting as a safety feature in case of failure of the pivot bolt coupling the lower support arm with the main support pole, since in such circumstances, the adjustment cylinder prevents the entire unit from falling. The height adjustment mechanism may enable height adjustment with minimal effort, that is, without requiring substantial physical strength. A crank arm is accessible from the main support pole to facilitate actuation of the screw jack, wherein the adjustment cylinder is responsive thereto. The crank arm is removable in order to prevent any potential interference therefrom during play, and in order to prevent any unauthorized height adjustment. The crank arm directs expansion of the screw jack, wherein the lower support arm of the backboard is pivoted upward in response to the expansion, and the upper support arms pivotally respond to movement of the lower support arm, thus maintaining a consistent or relatively consistent parallelogram profile at all heights, and enabling quick and easy backboard and goal height manipulation relative to the ground.

Referring now to FIG. 1, which shows one embodiment of a basketball goal system 10, comprising a main support pole 20, height adjustment mechanism 40, V-shaped backboard support mechanism 60, lower backboard support member 90 (or lower support arm), backboard frame 140, and rim connection assembly 200. Although shown using height adjustment mechanism 40, one skilled in the art should readily recognize that the embodiments of the basketball goal system described herein can also be utilized in a non-pivoting, static height conformation, wherein the structural enhancements provided by the combination of V-shaped backboard support mechanism 60 and lower backboard support member 90, among other enhancements described below, can be realized in the absence of height-adjustability.

In one embodiment, the main support pole 20 is formed from steel, which may be powder coated. The main support pole 20 may define a generally square-shaped cross-section (e.g., six-inch (6") by eight-inch (8")). Other appropriately sturdy materials can be utilized in lieu of steel, and other shapes and dimensions can be utilized for main support pole 20, wherein, for example, a rectangular, circular, or elliptical shaped cross-section can be defined, and, for example, dimensional measurements can be greater or less than six or eight inches. In one embodiment, each elongated corner edge 22 of main support pole 20 is generally blunt, essentially defining a plurality of intervening angled walls 23. Alternately, padding or other protective materials (not shown) can be provided or formed around main support pole 20.

First end 24 of main support pole 20 is supported by base 25, wherein brace members 28 can be correspondingly positioned to extend between base 25 and intervening angled walls 23. Mounting apertures 26 can be defined through base 25, wherein the configuration thereof can be adaptable to a plurality of known mounting configurations, specifically including but not limited to nine inch (9") and ten-inch (10") center mounting configurations. Although industry standard ⅝" bolts maybe used through mounting apertures, testing has revealed that aggressive play may lead to significant torque and thus pole movement with ⅝" bolts. In one embodiment, bolt dimensions of at least approximately ¾" are used, and preferably 1" bolts, to reduce the torque and provide a safer installation. Although base 25 can comprise a steel plate having a generally square shape with a generally square-shaped central pole port 29 defined therein, any appropriately strong materials can be utilized, and other shapes can also be utilized. That is, base 25 can have a pyramidal shape, or can define any suitable generally flat shape, such as, for exemplary purposes, circular, elliptical, rectangular or irregular. Central pole port 29 can define the same shape as that defined by base 25 or can be differently shaped, wherein central pole port 29 is shaped to receive and generally abut main support pole 20. In some implementations, central pole port 29 and corresponding structures may be omitted (e.g., for direct concrete burial implementations).

Height adjustment mechanism 40 can be provided proximate to and partially within main support pole 20, wherein screw jack 41 (shown, for example, in FIGS. 6B and 6C) and gas strut 42 comprise adjustment components. It is recognized that, at least in some embodiments, more than one gas strut 42 can be incorporated, and/or other types of known adjustment components can be utilized in order to facilitate the raising and lowering of lower backboard support member 90. It is further recognized that height adjustment mechanism 40 can be any type of mechanism enabling appropriate movement of lower backboard support member 90.

Figure 6A:
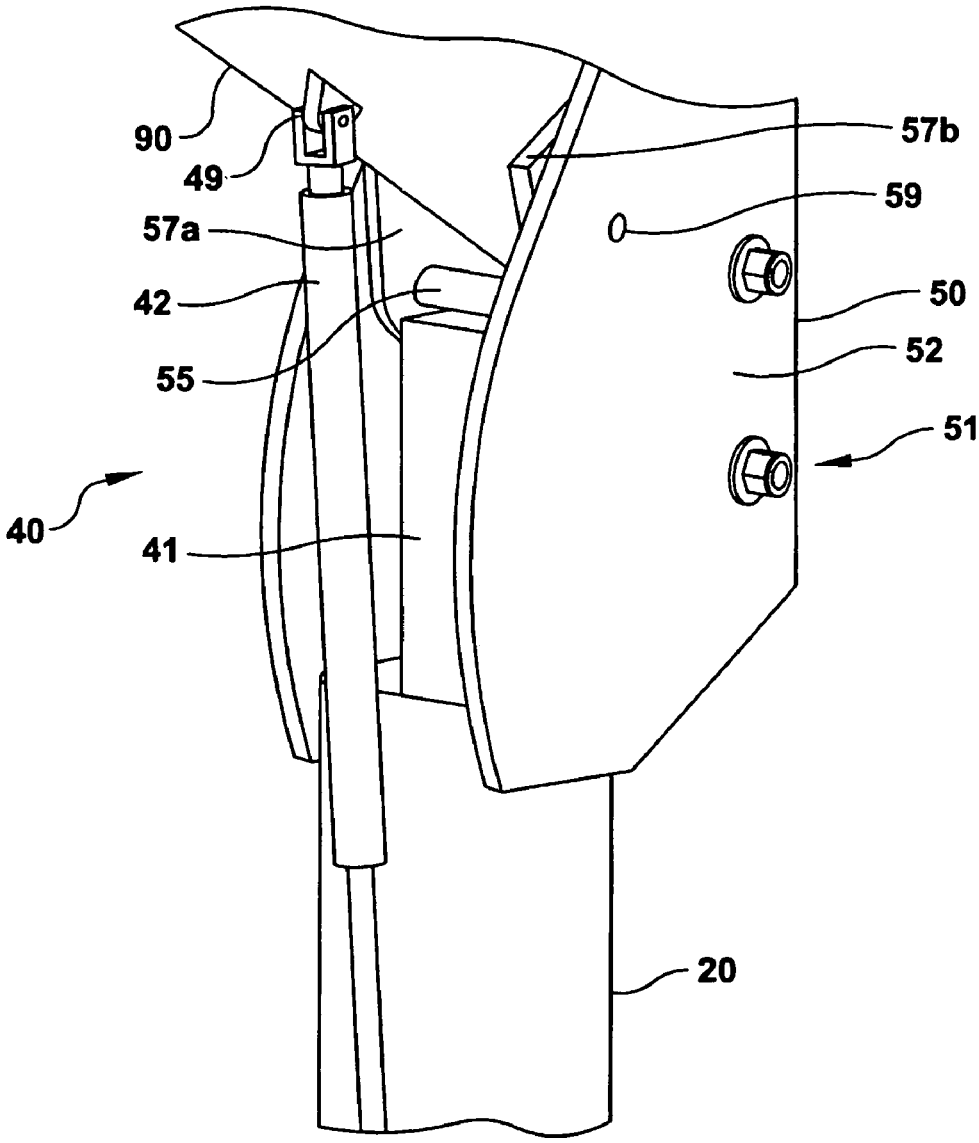
FIGS. 6A-6G are various schematic diagrams showing embodiments of a height-adjustment mechanism and cooperating components of the basketball goal system of FIG. 1.

FIGS. 6A-6G are used to describe the height adjustment mechanism 40 and various components that cooperate with the same to provide height adjustment functionality. FIG. 6A illustrates a detail of the upper portion of the height adjustment mechanism 40 shown in cooperation with the lower backboard support member 90, a support member 50, and the main pole 20. The support member 50 comprises a bracket 52, which comprises a slot 59 that is utilized for fixed height systems, as described below, and a pivot point 51 that represents the pivot point for the lower backboard support member 90. At the pivot point, a bolt, pin, or like component is provided that couples opposing flanges 57*a* and 57*b* of the lower backboard support member 90 to the bracket 52. The height adjustment mechanism 40 comprises the gas strut 42 and screw jack 41. The gas strut 42 comprises a coupling mechanism 49 that couples the gas strut 42 to the underside of the lower backboard support member 90. In one embodiment, the coupling mechanism 49 comprises a clevis pin assembly.

Figure 6B:
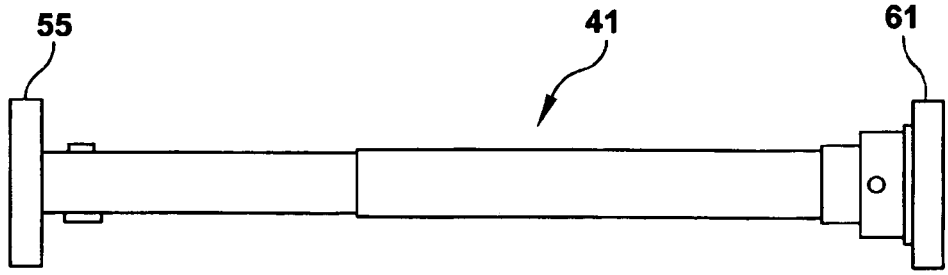
Figure 6C:
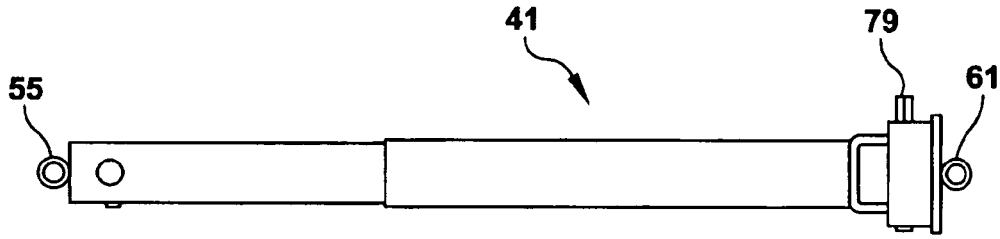

Referring to FIGS. 6B and 6C, shown are front and side elevation views of the screw jack 41. The screw jack 41 comprises hollow, opposing end coupling members 55 and 61 for coupling (e.g., via pin or like component) to the flanges 57*a* and 57*b* of the lower backboard support member 90 and the main pole 20, respectively. Internal to the screw jack 41 is a gear and pin assembly that enables rotation of the screw jack 41, as is well-known to those having ordinary skill in the art. Screw jack 41 also comprises adjustment member 79, which upon the imposition of rotational engagement by crank arm 47 (FIG. 6F) causes screw jack adjustment. The adjustment member 79 may comprise a multi-sided bolt (e.g., having an octagon shape) or like functioning component that can be rotatably adjusted.

Figure 6D:
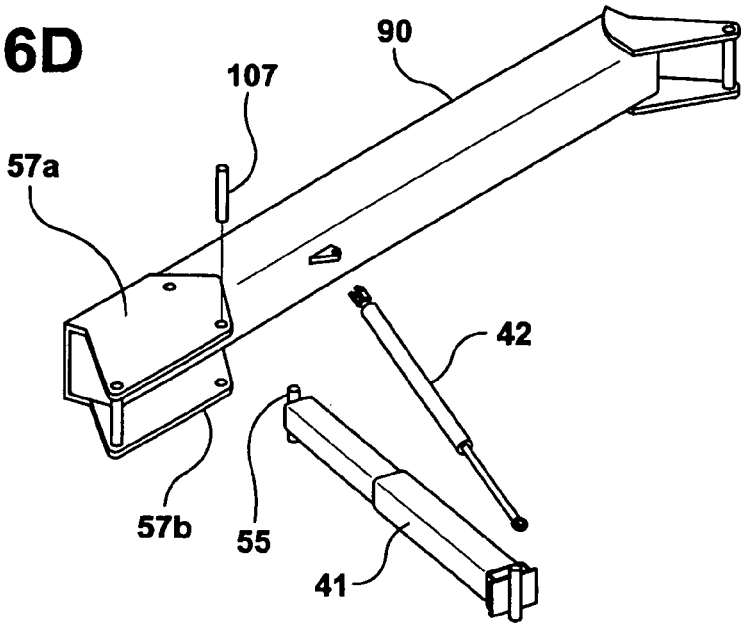
Figure 6E:
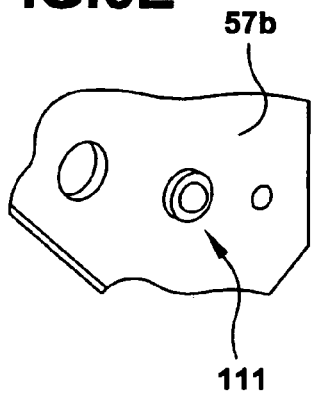

FIG. 6D shows a partial schematic view of the disassembled screw jack 41, gas strut 42, and lower backboard support member 90. As shown, a pivot pin 107 is inserted through flanges 57*a* and 57*b* of the lower backboard support member 90 and through the hollow coupling member 55 of the screw jack 41. Synthetic (e.g., nylon top hat guides) washers 111 are placed at each end of the inserted pivot pin to facilitate movement and stability of the flanges 57*a* and 57*b* relative to the bracket 52, as shown in FIG. 6E. That is, the synthetic washers 111 assist in centering the lower backboard support member 90 between the interior surface of the walls of the bracket 52 (minimizing vibration and improving stability) and also mitigate binding of the flanges 57*a* and 57*b* of the lower backboard support member 90 to the interior surface of the walls of the bracket 52.

Figure 6F:
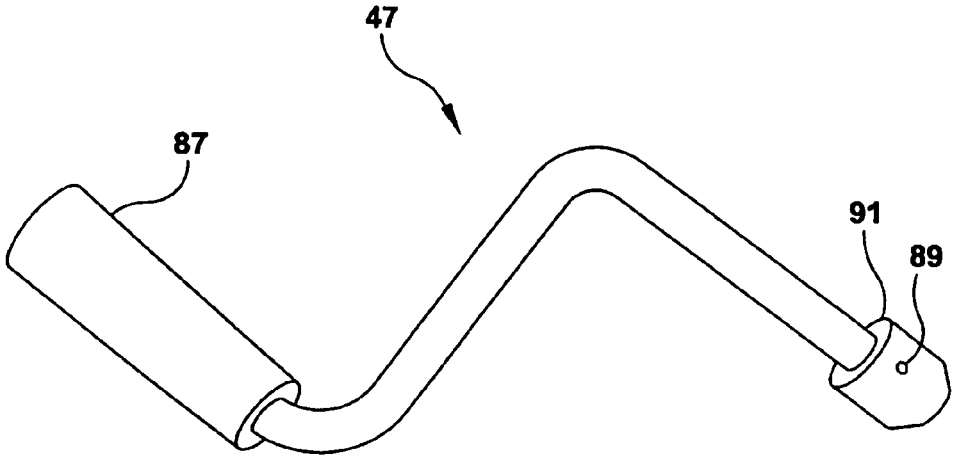

FIG. 6F provides a schematic diagram of the crank arm 47, having a handle 87 for interface with a user or other source of force, and a socket 89 that removably couples to adjustment member 79. In one embodiment, the socket 89 comprises a shear pin 91. The shear pin 91 is configured to withstand a predetermined threshold degree of force before failure (i.e., failure threshold), the failure threshold preferably of lower value than the failure threshold of the pin of the screw jack pin of the gear and pin assembly. For instance, the shear pin 91 may withstand a force of up to 50 pounds (lbs.), and the pin of the gear and pin assembly may withstand forces of up to 100 lbs. One benefit of such two-tiered failure thresholds is that excessive crank turns may result in failure of the crank arm 47 before failure of the screw jack 41, the former which requires an inexpensive repair and/or replacement cost compared to the repair and/or replacement cost of the screw jack 41.

Figure 6G:
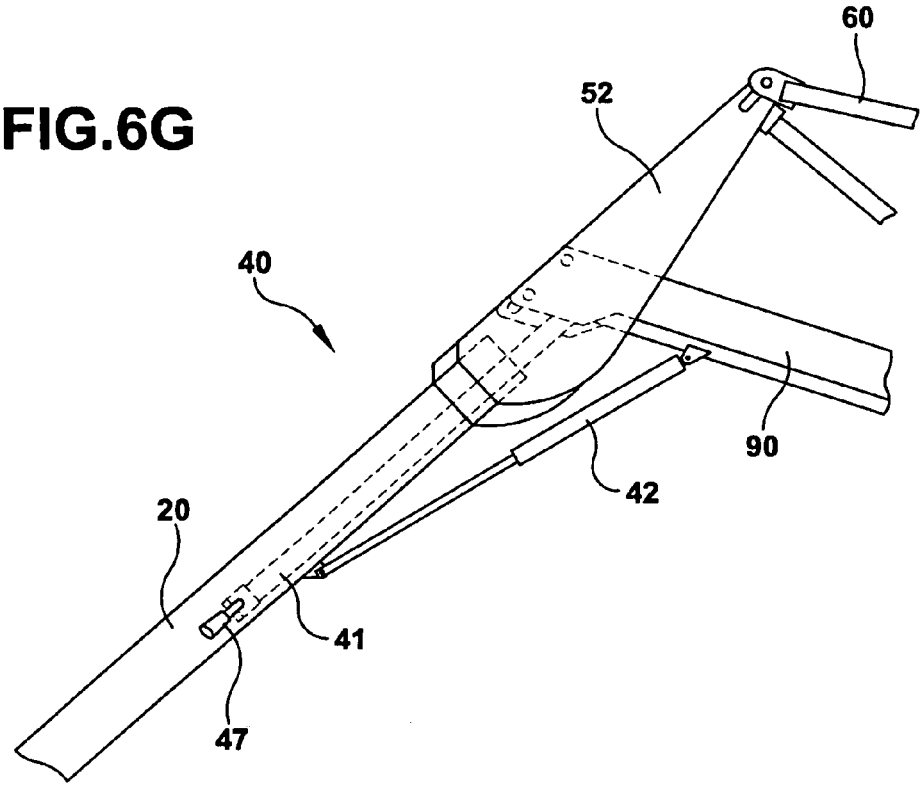

FIG. 6G provides another view of the height adjustment mechanism 40, and is used to illustrate operation of the height adjustment mechanism 40 and related components. Portions of main support pole 20 and lower backboard support member 90 are shown in transparent view to illustrate cooperation between screw jack 41 and lower backboard support member 90. Crank arm 47 may be removably held proximate to main support pole 20 in rotational communication with height adjustment mechanism 40, specifically proximate screw jack 41. For example, and with continued reference to FIGS. 6A-6F, the user couples socket 89 to adjustment member 79, and effects rotation of crank arm 47 in a first direction, such as clockwise, which engages screw jack 41 of height adjustment mechanism 40, and causes screw jack 41 to extend, causing lower backboard support member 90 to pivot upward relative to the ground, and results in extension of gas strut 42. Also, rotation of crank arm 47 in a second direction, such as counter-clockwise, may engage height adjustment mechanism 40, causing screw jack 41 and gas strut 42 to retract, and cause lower backboard support member 90 to pivot downward relative to the ground. Other adjustment mechanisms may be used.

In one embodiment, main support pole 20 comprises an oval slot (not shown), into and through which the socket 89 of crank arm 47 is positioned to engage adjustment member 79 of screw jack 41. In one embodiment, the slot comprises an oval configuration having dimensions of approximately 1-inch width and 1.75-inch length (tall). In some implementations, as the crank arm 47 is adjusted to raise the lower backboard support member 90, the screw jack 41 may tend to move closer to the inner surface of the main support pole 20, causing the crank arm 47 to be positioned at an angle to the main support pole 20 that can cause binding of the crank arm 47 and the edges of the slot if the slot is of a circular or square configuration as opposed to an oval configuration. However, in some embodiments, other geometric configurations of the same or different dimension for the slot may be used that obviate the potential for binding.

Referring to FIG. 1, support member 50 can be positioned proximate upper end 27 of main support pole 20, wherein support member 50 comprises bracket 52, wherein bracket 52 may define a connective and supportive link between main support pole 20 and upper and lower backboard support members 60 and 90, respectively. In one embodiment, bracket 52 may include a profile defining a teardrop shape and a cross-section defining a U-shape. The base of the U-shaped cross-section can be defined by generally rectangularly-shaped rear wall 53 (FIG. 3A), wherein the sides of the U-shaped cross-section are defined by teardrop-shaped side walls 54*a* and 54*b*. In one embodiment, a "boxed" configuration for the bracket 52 is used. FIG. 3B provides a schematic of a boxed configuration as viewed from underneath and at an angle behind the bracket 52, wherein the rear wall 53*a* extends to the main support pole 20. For instance, the rear wall 53*a* may comprise a plate welded to opposing rear edges of the bracket 52, extending from the top of the bracket 52 to the main support pole 20. Such a boxed configuration prevents or mitigates twisting of the bracket 52 under torque loads by, for instance, adding rigidity to the entire bracket structure. One skilled in the art should readily recognize that bracket 52 can also be formed without rear wall 53, wherein the rear area can remain open.

Support member 50, arranged in the form of bracket 52 in one embodiment, can be secured to upper end 27 of main support pole 20, forming a main pole structure having at least two segments. Alternatively, support member 50 can be integrally formed with main support pole 20. In one embodiment, upper and lower backboard support members 60 and 90, respectively, are pivotally attached to bracket 52, wherein lower backboard support member 90 can be pivotally secured between teardrop-shaped side walls 54*a* and 54*b* via flanges 57*a* and 57*b*, and wherein upper backboard support members 60 can be pivotally secured outside of teardrop-shaped side walls 54*a* and 54*b*, that is, not therebetween. This arrangement maximizes torque resistance and minimizes vibration by inhibiting side-to-side movement of lower backboard support member 90, as restrictively positioned between teardrop-shaped side walls 54*a* and 54*b*. The opposing position of backboard support members 60 and 90 relative to teardrop-shaped side walls 54*a* and 54*b* dampens vibration therebetween.

Figure 4:
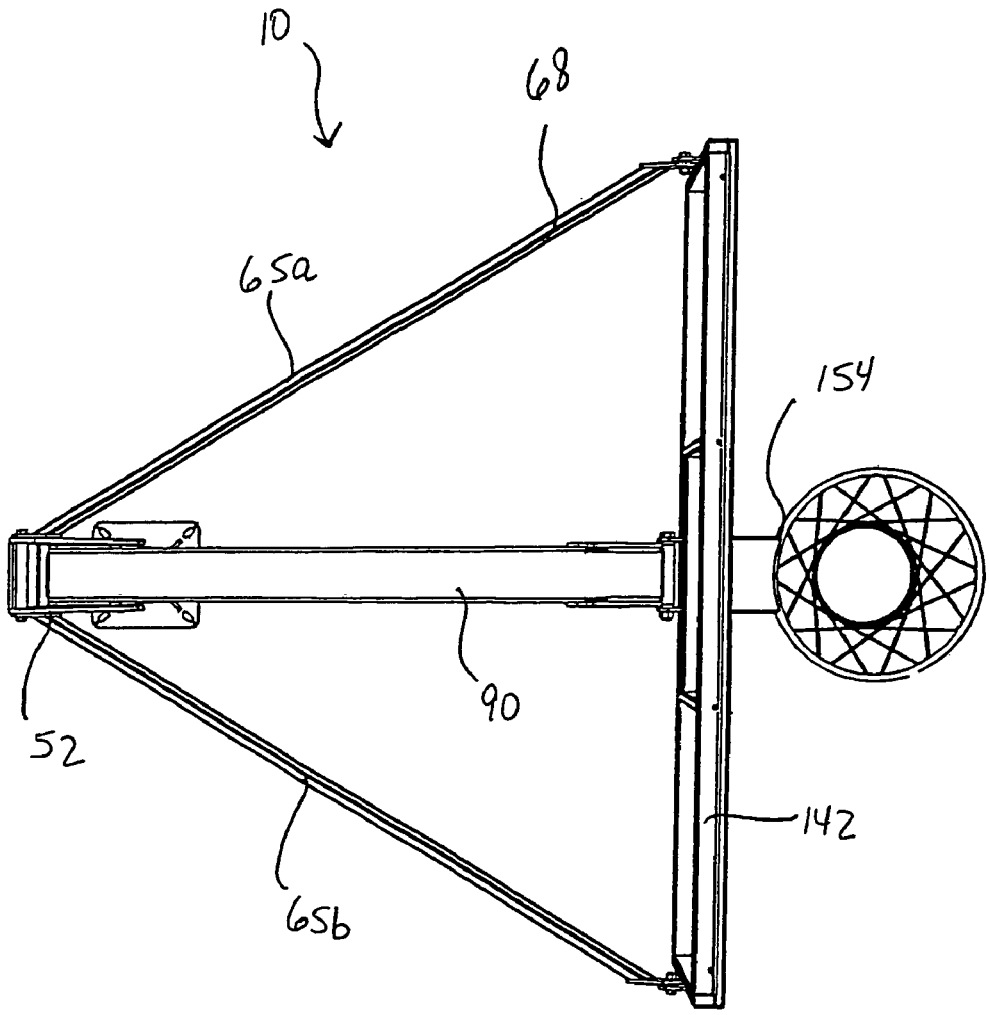
FIG. 4 is an aerial view of the basketball goal system of FIG. 1.
Figure 11:
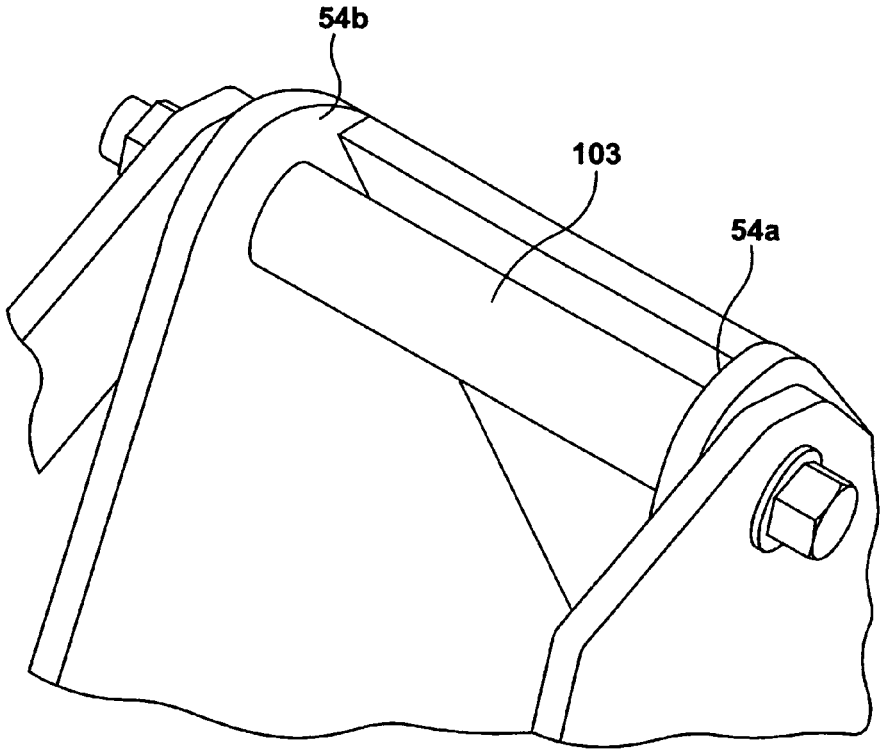
FIG. 11 is a schematic diagram of a pivot rod of the basketball goal system of FIG. 1.

Upper backboard support members 60 may define a "V"-shape, wherein vertex 62 is positioned proximate upper end 56 of bracket 52, and wherein distal ends 64*a* and 64*b* of each upper backboard support member 65*a* and 65*b*, respectively, can be pivotally secured to the upper half of backboard frame 140, proximate peripheral side edges 142*a* and 142*b*, respectively, thereby reducing torque. The substantially straight form of upper backboard support members 60 define triangular reinforcing structure 68, when viewed from above as seen in FIG. 4, which enables the provision of a true, solid rebound with minimized vibration. Vertex 62 can be defined by pivot rod 66, and may extend between teardrop-shaped sidewalls 54*a* and 54*b* of bracket 52. Pivot rod 66 comprises a bolt, pin, or similar component that is disposed and secured between sidewalls 54*a* and 54*b* using a plurality of synthetic (e.g., nylon) and/or metal bushings and washers between contact points to enable freedom of movement. One skilled in the art should recognize that pivot rod 66 can alternately be integrally formed with bracket 52, as long as the structural integrity and pivotal relationship of upper backboard support members 60 is not compromised. In some embodiments, as shown in FIG. 11, pivot rod 66 may be enclosed within sleeve 103. Sleeve 103 can be welded to opposing sidewalls 54*a* and 54*b*, or fixed thereto using other attachment mechanisms. Pivot rod 66 is free to allow rotation of upper backboard support members 60, while sleeve 103 provides rigidity to the upper structure proximal to the upper backboard support members 60.

Figure 12:
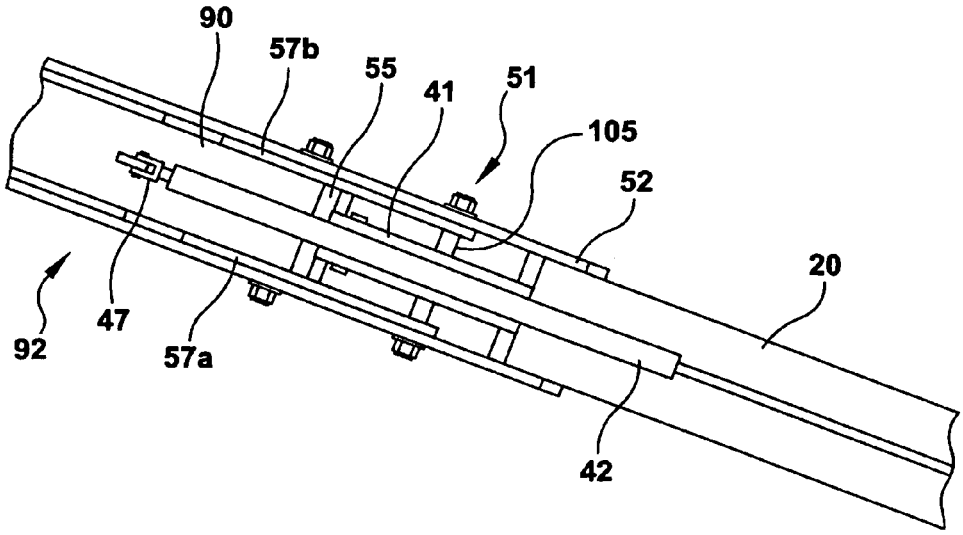
FIG. 12 is a schematic diagram of the underside of a lower backboard support member of the basketball goal system of FIG. 1.

First end 92 of lower backboard support member 90 can be pivotally secured at pivot point 51 proximate lower half 58 of supportive connector bracket 52, and thereby proximate upper end 27 of main support pole 20, wherein second, or distal end 94 may be positioned proximate rim connection assembly 200. FIG. 12 provides an illustration of a view from the underside of the first end 92 of the lower backboard support member 90. As shown, the gas strut 42 is coupled to the underside of the lower backboard support member 90 via coupling mechanism 49. Screw jack 41 is coupled to flanges 57*a* and 57*b* via coupling member 55 (and pivot pin 107) as described above. At pivot point 51, a pivot rod 105 is used to provide coupling between bracket 52 and lower backboard support member 90.

Figure 2:
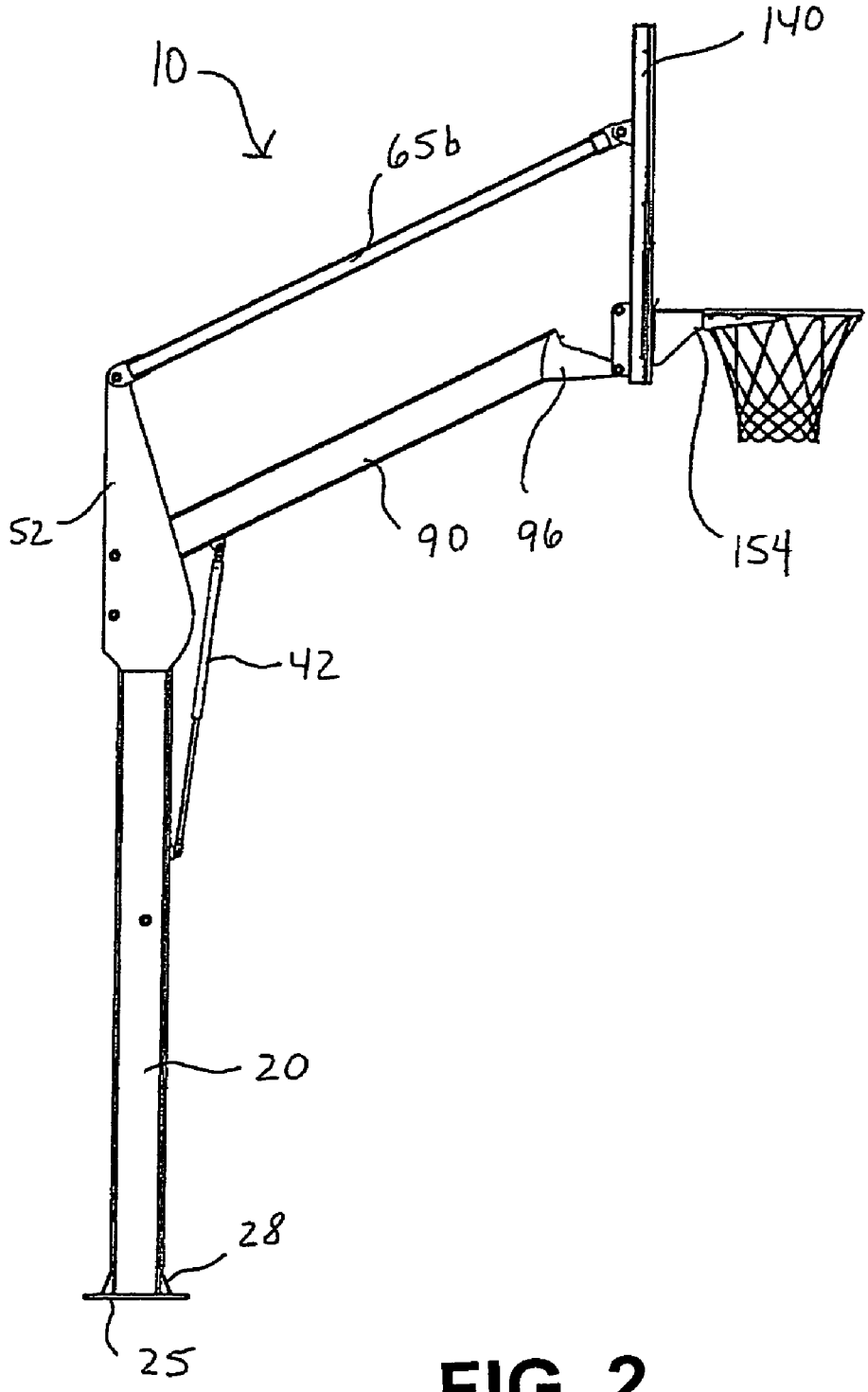
FIG. 2 is a side view of the basketball goal system of FIG. 1.
Figure 3A:
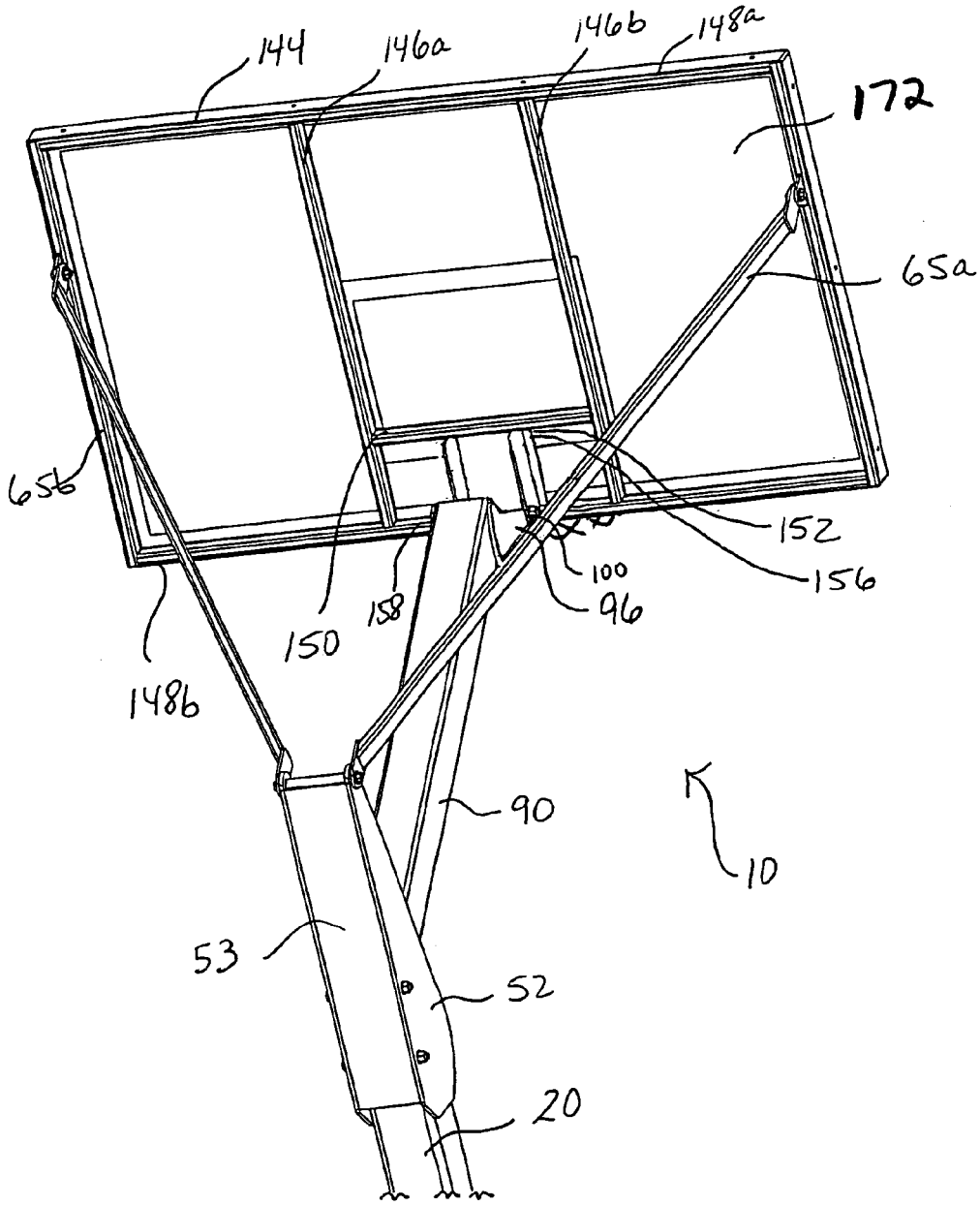
FIG. 3A is an aerial perspective view of the basketball goal system of FIG. 1.
Figure 3B:
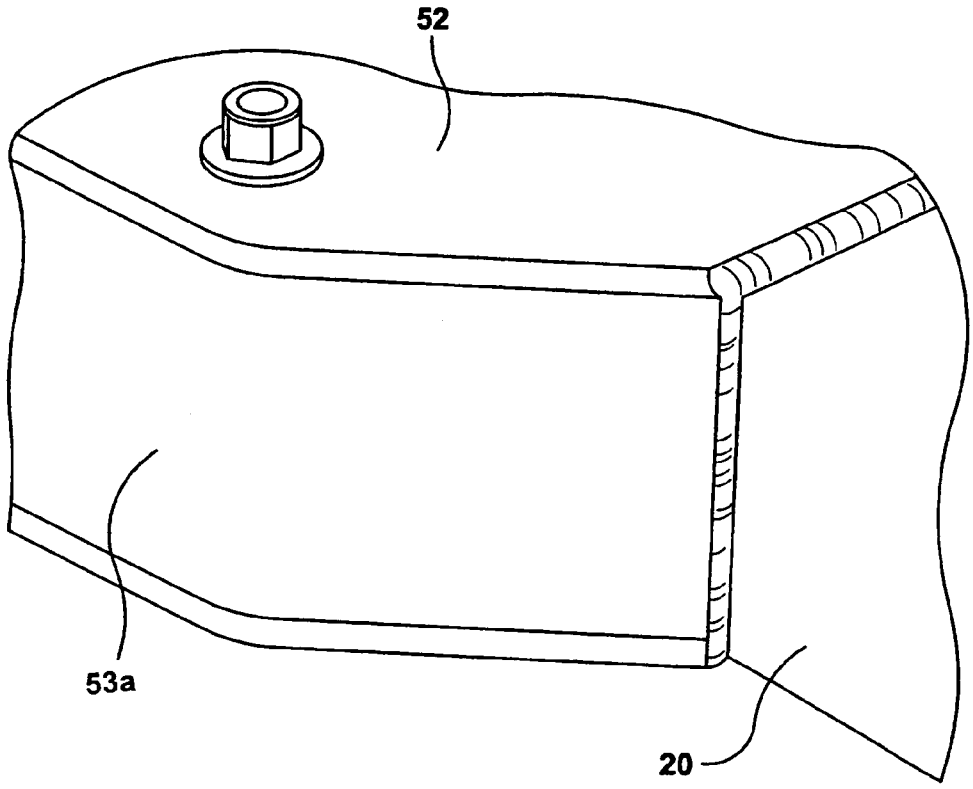
FIG. 3B is a lower angled view of a rear wall of a bracket of the basketball goal system of FIG. 1.
Figure 5:
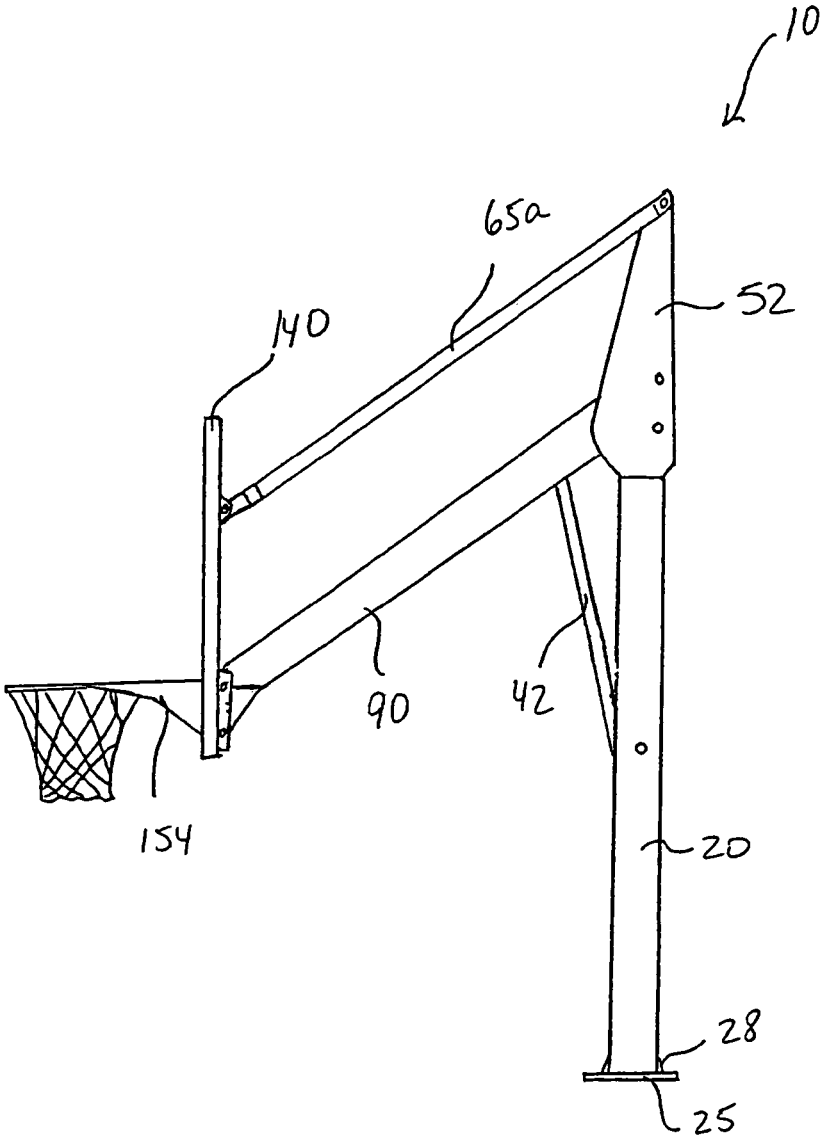
FIG. 5 is a side view of the basketball goal system of FIG. 1, showing the backboard goal in a low-height position.

Referring now to FIG. 3A, with continued reference to FIG. 1, a pivot structure 96 is shown, which may be positioned proximate second end 94 of lower backboard support member 90. Pivot pin 100 secures pivot structure 96 to rim connection assembly 200 in such a manner so as to facilitate cooperative movement upon backboard height adjustment to ensure consistent overhang. That is, on profile, lower backboard support member 90 can be positioned substantially parallel to upper backboard support members 60, wherein strategically adjustable pivoting ensures that the relative position of support members 60 and 90 to each other and the relative position of backboard frame 140 to main support pole 20 remain essentially constant irrespective of goal height adjustment activity. The pivot structure 96 enables clearance between the lower backboard support member 90 and the support plate 156 of the backboard frame 140 throughout a range of movement (e.g., from 5/12 ft. to 10 ft.), as illustrated in FIGS. 2 and 5.

Figure 7A:
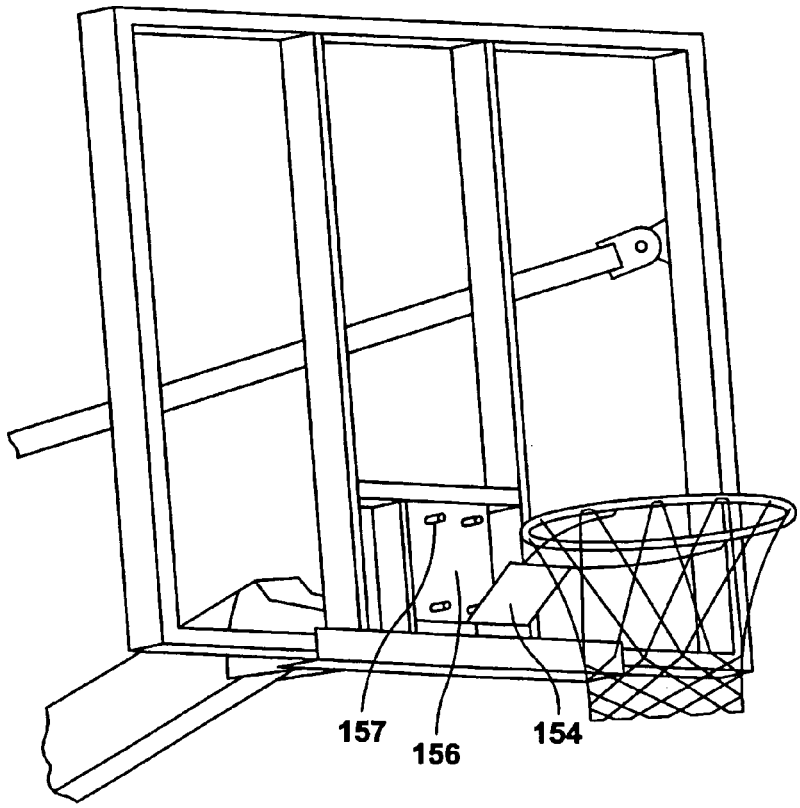
FIGS. 7A and 7B are various schematic diagrams showing a rim connection assembly of the basketball goal system of FIG. 1.
Figure 7B:
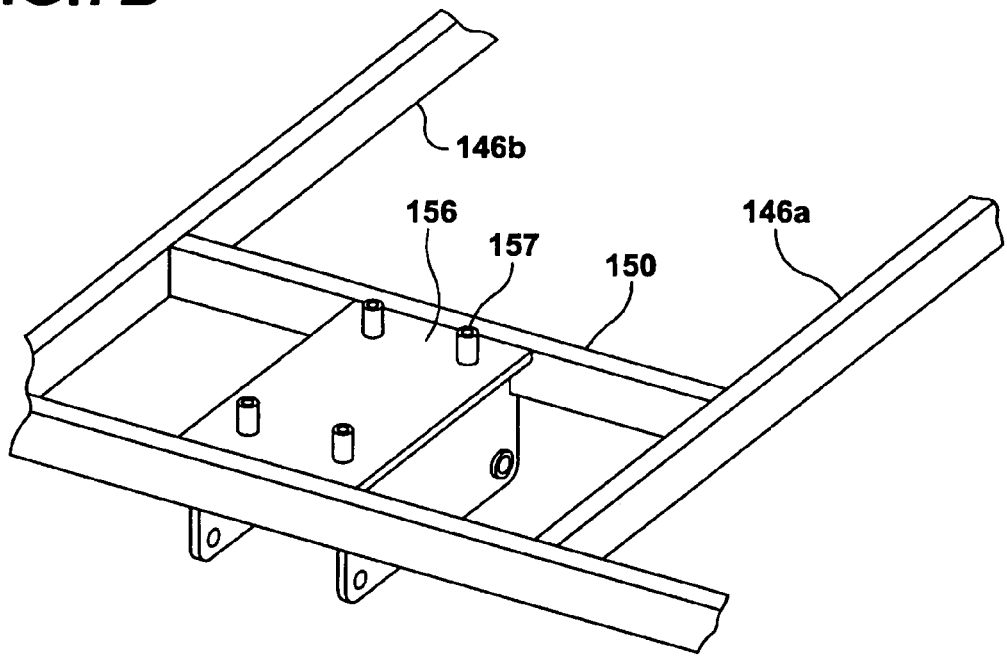

Backboard frame 140 can be defined by essentially continuous peripheral edge 144, two vertical support members 146*a* and 146*b* extending between upper and lower peripheral edges 148*a* and 148*b*, respectively, and horizontal support member 150 extending between vertical support members 146*a* and 146*b*, proximate the connection point 152 for rim 154. Referring now to FIGS. 7A-7B, with continued reference to FIGS. 1 and 3, support plate 156 can be secured to backboard frame 140, wherein a plurality of generally tubular-shaped members 157 are secured proximate support plate 156, extending outwardly therefrom, enabling rim 154 to be fastened to backboard frame 140 without compromising the glass or acrylic substrate 172 of backboard frame 140, and effectively transferring tension from aggressive play, or slam-dunks, to the frame, thus preventing backboard breakage and reducing distortion of rim 154 from heavy loads. In particular, vertical support members 146*a* and 146*b*, coupled with horizontal support member 150, facilitate the transfer of forces about peripheral edge 144 of backboard frame 140, thereby substantially avoiding localization of forces at central region 158 of lower peripheral edge 148*b*.

The basketball system 10 is suitable for installation in any environment and/or for portable use. Therefore, while the disclosed systems are described conveniently with the preferred embodiments enabling permanent installation via base 25, alternate installations are possible. For example, first end 24 of main support pole 20 can be secured within a weighted movable base, as is known in the art, in order to facilitate portability. Also, bracket 52 can be supported by a wall or ceiling mount structure, in lieu of main support pole 20, wherein height adjustment features carried by main support pole 20 can be reconfigured, continuing to function in an equivalent manner, yet from a different support position.

Further, the basketball goal system 10 can be adjusted to operate as a fixed height system with minor adjustments. The fixed height system will generally omit the crank arm 47, screw jack 41, and gas strut 42. In installation, the lower backboard support member 90 is positioned at the desired height, and a securing member (e.g., 5/8 inch double threaded bolt) is inserted in slot 59 (FIG. 6A) and secured (e.g., via nut and washer).

Figure 8:
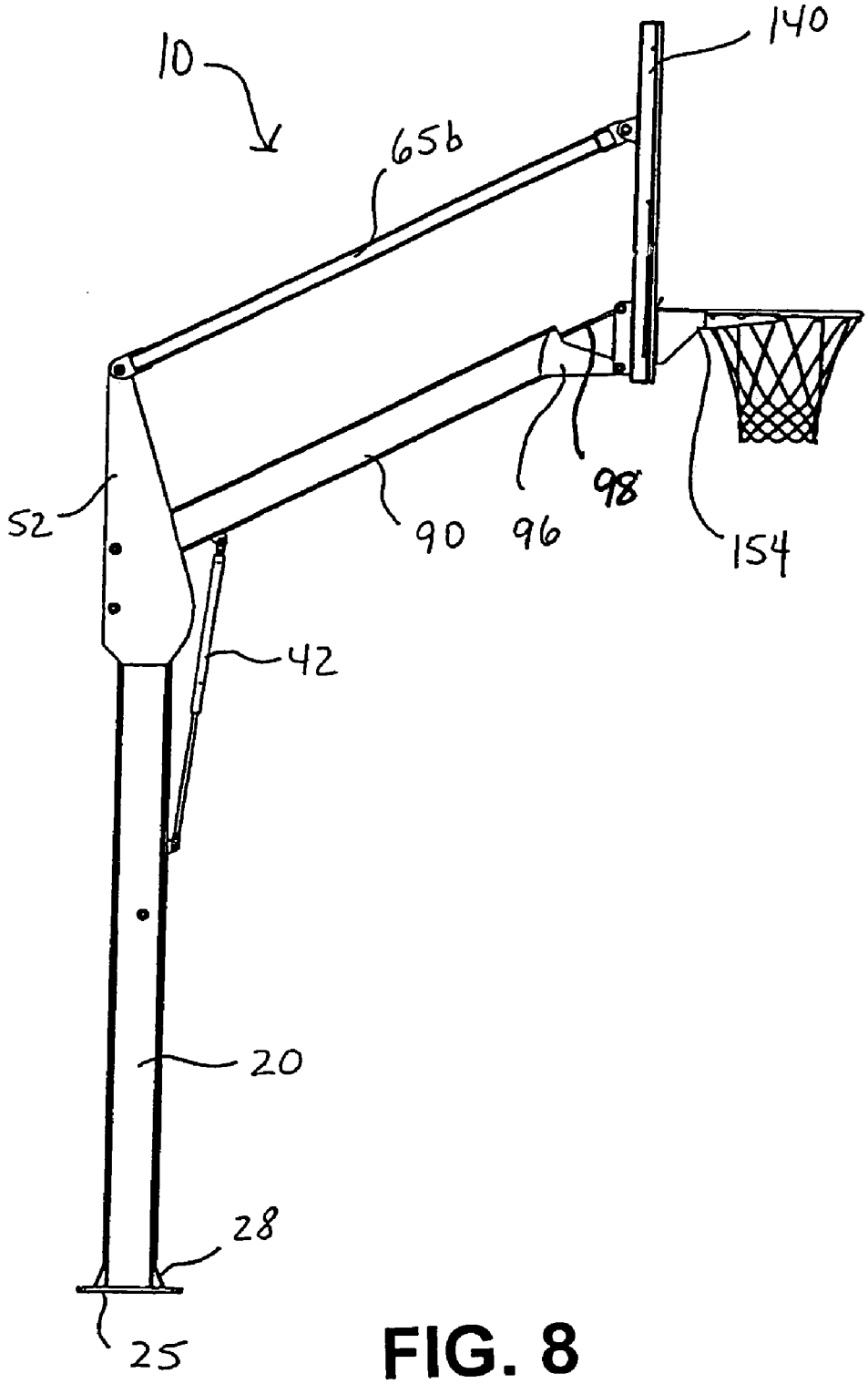
FIG. 8 is a side view of an embodiment of a basketball goal system, showing a belt mechanism embodiment.

In another embodiment, as depicted in FIG. 8, pivot structure 96 may work in cooperation with a belt member 98, wherein belt member 98 can shorten or lengthen, as appropriate.

In some embodiments, the basketball goal system 10 can be provided with an alternate base structure, or can be manufactured from alternate materials in order to facilitate installation and use proximate to or within a swimming pool, wherein the advantageous structure and height adjustment features can be utilized for water-based basketball play.

In one implementation, basketball goal system 10 is installed via base 25. Crank arm 47 is selectively installed and rotated, whereby lower backboard support member 90 and upper backboard support members 60 pivot relative to main support pole 20 and relative to backboard frame 140, enabling a selectable play height essentially between 5.5 feet and 10 feet, wherein irrespective of play height, overhang, or the distance between main support pole 20 and backboard 142, is approximately four feet. During play, if a player shoots the ball and the ball hits the backboard substrate 172, the structure of backboard frame 140, coupled with the support structure defined by upper and lower backboard support members 60 and 90, effectively dampens the torque or twisting of backboard frame 140 relative to main support pole 20. During aggressive play, if a player slam-dunks, or hangs on rim 154, rim connection assembly 200, coupled with the supportive and tension directing structure of backboard frame 140, effectively distributes the forces received therefrom away from rim 154 and connection 152 thereof about backboard frame 140 and ultimately main support pole 20, thereby substantially eliminating the possibility of breakage of backboard substrate 142 and reducing the chance of distortion to rim 154.

Figure 9:
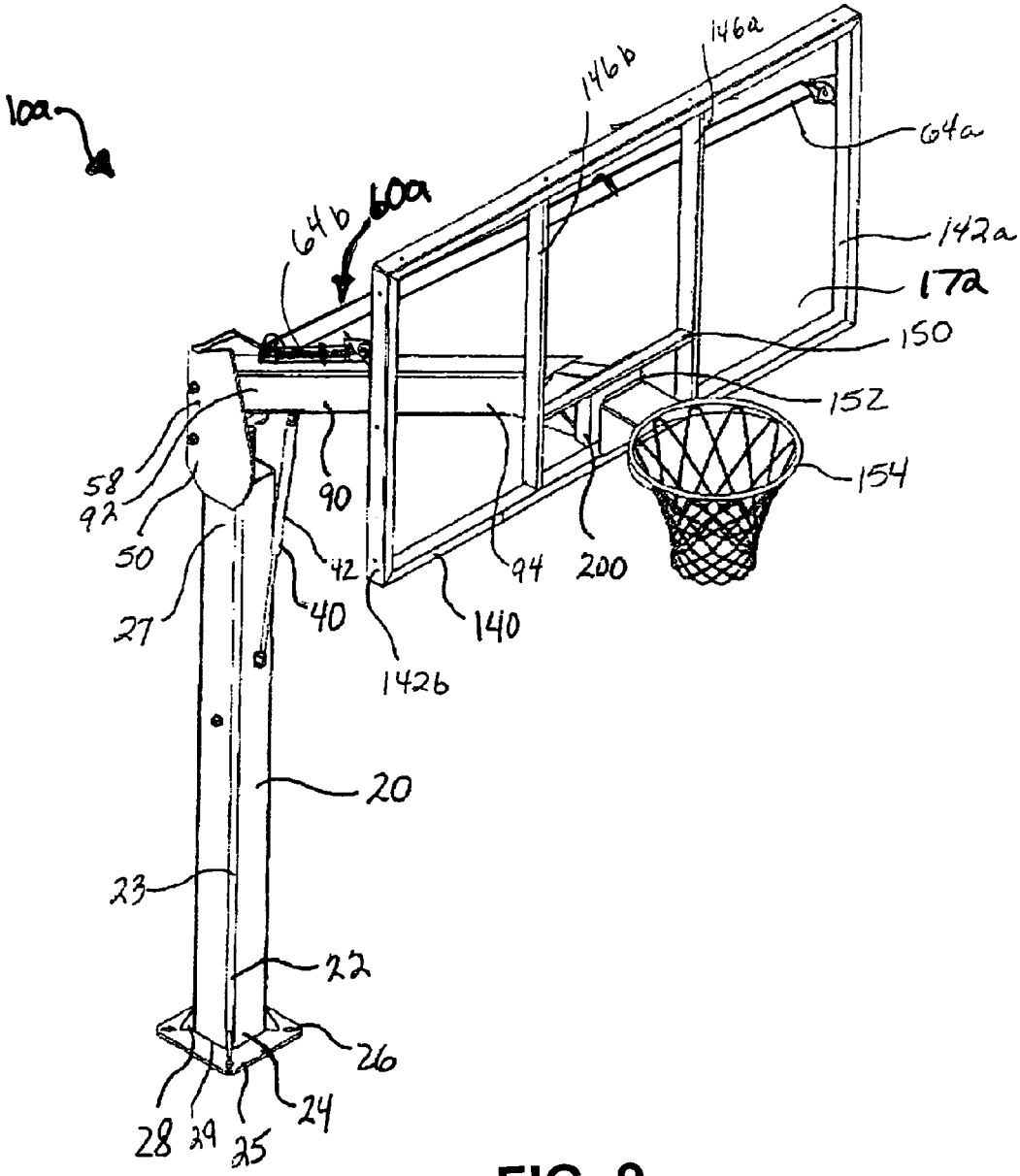
FIG. 9 is a front perspective view of an embodiment of a basketball goal system.

FIG. 9 is a front perspective view of an embodiment of a basketball goal system 10*a*. The basketball system 10*a* includes much of the features and elements of the basketball system 10 of FIG. 1. The basketball system 10*a* comprises backboard support members 60*a* (having distal ends 64*a* and 64*b*) connected from the edge 142*a*, 142*b* of each side of the backboard to a pivot point disposed on lower support member 90. This pivot point may enable free movement of the support member 60*a* in linear fashion, enabling the goal to be raised and lowered while still maintaining a vertical plane on the backboard frame 140. This arrangement also provides torque reduction and stabilization features needed to allow for aggressive play with a minimum of movement from the system 10*a*. The placement of the support member attaching points on the backboard peripheral side edges 142*a*, 142*b* allows for free movement of the system 10*a* while still maintaining the design features resulting in desired playability, as described above.

Figure 10:
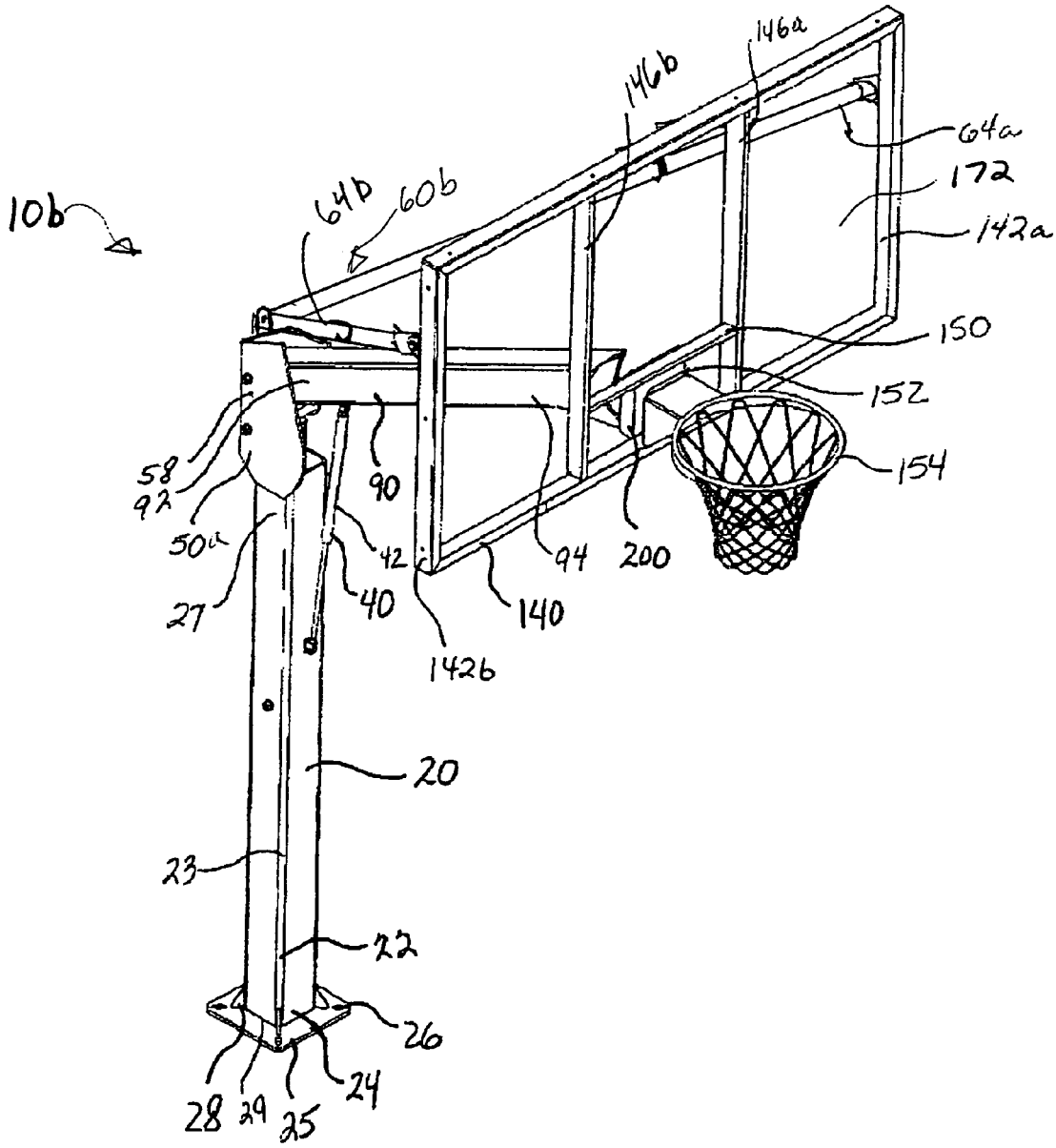
FIG. 10 is a front perspective view of an embodiment of a basketball goal system.

FIG. 10 is a front perspective view of an embodiment of a basketball goal system 10*b*, which depicts an arrangement comprising backboard support members 60*b* connected from the edge 142*a*, 142*b* of each side of the backboard frame 140 to a pivot point on the main support pole 20. This system 10*b* can be fitted with expanding gas cylinders (e.g., gas struts) enabling the goal to be raised and lowered while still maintaining a vertical plane on the backboard frame 140. This arrangement also provides torque reduction and stabilization features needed to allow for aggressive play with a minimum of movement from the unit 10*b*. The placement of the attaching points on the peripheral side edges 142*a*, 142*b* of the backboard frame 140 allows for free movement of the system 10*b* while still maintaining the design features resulting in the desired playability described above.

Note that one or more features of one embodiment may be used in lieu of like functioning features in other embodiments disclosed above. For example, the pivot structure 96 of FIG. 1 and cooperating elements may replace the pivot structure and cooperating elements of FIG. 9.

Figure 13:
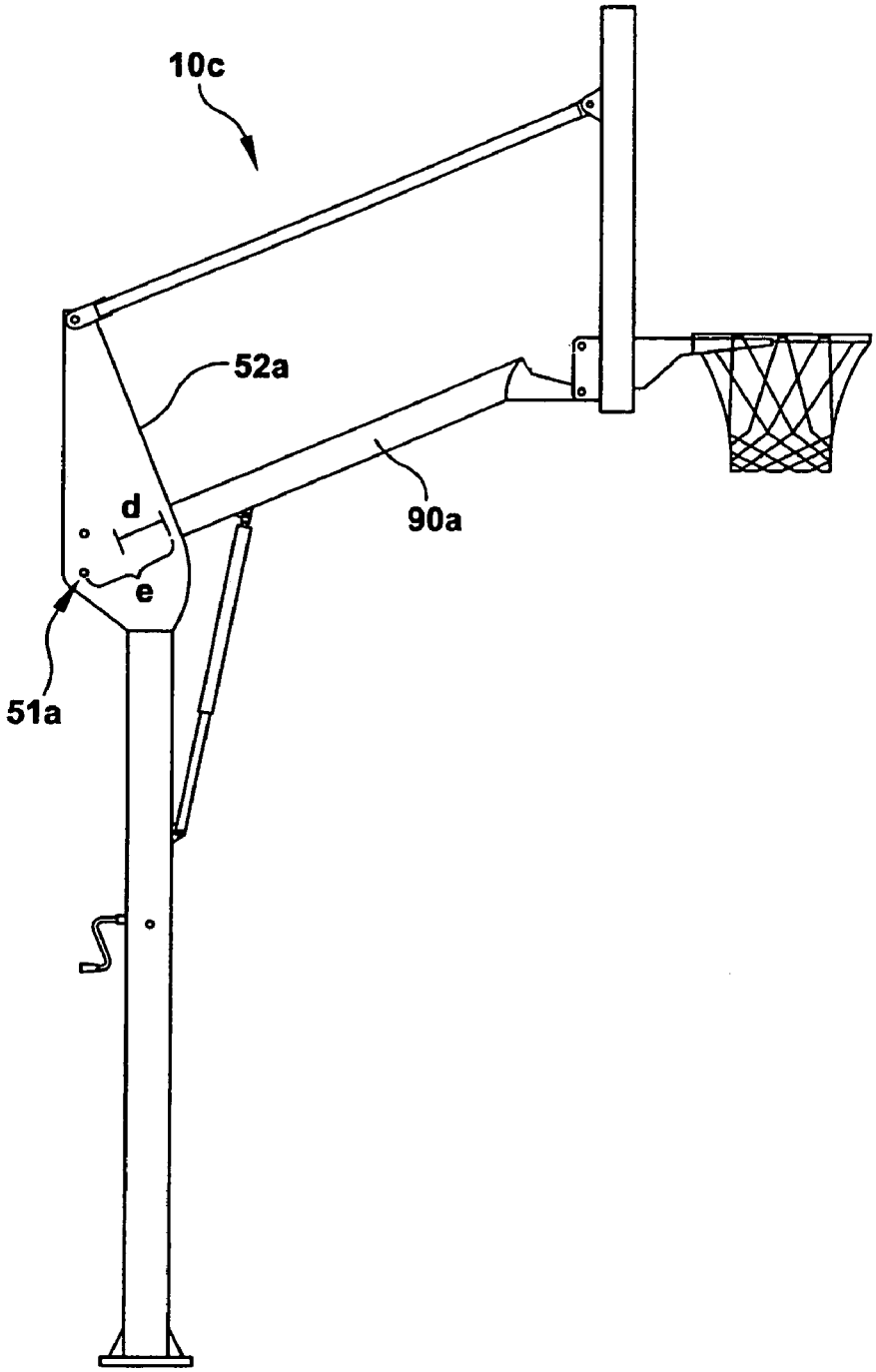
FIG. 13 is a schematic diagram of an embodiment of a basketball goal system with an extended width bracket.

Another embodiment of a basketball goal system 10*c* is shown in FIG. 13, which is similar to the structure 10 shown in FIG. 2 with an extended width bracket 52*a*. Dimension "d" represents the length between the location where the screw jack 41 couples to the lower backboard support member 90*a* and the previous pivot point 51 of the lower backboard support member 90*a* for the basketball goal system 10 shown in FIG. 2. The previous pivot point 51 is a location where the flanges of the 57*a*, 57*b* of the lower backboard support member 90 are connected to the bracket

52. Extended dimension "e" represents the length between the location where the screw jack 41 couples to the lower backboard support member 90*a* and the pivot point 51*a* of the lower backboard support member 90*a* for the basketball goal system 10. In other words, bracket 52*a* is wider than bracket 52 (and the flanges and/or lower backboard support member 90*a* are extended in length compared to the lower backboard support member 90 shown in FIG. 1, for example), thus enabling the longer dimension "e". The longer the distance between the screw jack coupling point and the pivot point 51*a*, the heavier the loads imposed to the rim 154 that can be borne. For instance, by changing the distance between the pivot point 51*a* and the screw jack coupling point six (6) inches, the maximum load limit (imposed on the rim 154, for example) of basketball goal system 10*c* increases from approximately 240 lbs to approximately 740 lbs. This maximum load increase translates to a more robust basketball goal system. An additional benefit of this increased distance (dimension "e") between pivot point 51*a* and the screw jack coupling point is that raising and lowering the lower backboard support member 90*a* is facilitated due to basic leverage principles.

It should be emphasized that the above-described embodiments of the disclosure, particularly, any "preferred" embodiments, are merely possible examples of implementations, merely set forth for a clear understanding of the principles of the disclosed systems. Many variations and modifications may be made to the above-described embodiment(s) without departing substantially from the spirit and principles of the disclosed systems. All such modifications and variations are intended to be included herein within the scope of the disclosure.

What is claimed is:

1. A basketball goal system, comprising:

a segmented upright frame, having a first segment and a second segment;

first and second upper backboard support members and a lower backboard support member;

a pivot structure;

a rim connection assembly; and a backboard frame having a substrate, wherein the first segment comprises a base having mounting apertures configured to receive a plurality of bolts each of at least ¾ inches diameter that secure the first segment to a surface, the first segment having a screw jack coupled within the first segment, the screw jack having a gear and pin assembly, the screw jack having an adjustment member coupled to the gear and pin assembly to cause movement of the screw jack upon imposition of force to raise and lower the screw jack, the screw jack having a coupling mechanism, the first segment having a slot configured to enable reception and movement of a removable crank arm without binding of the crank arm to a surface of the slot during an entire range of the movement of the screw jack, the crank arm having a socket configured to removably couple to the adjustment member, the socket having a shear pin having a threshold failure lower than a threshold failure of the pin of the gear and pin assembly, the first segment coupled to a gas strut that moves in coordination with the screw jack, the second segment having two side walls and a rear wall connected to the two side walls, the rear wall abutted adjacent the first segment, the second segment coupled to the first and second upper backboard support members and the lower backboard support member, the lower backboard support member pivotably coupled to the second segment at a pivot point, the pivot point extending beyond a vertical plane corresponding to the first segment, the lower backboard support member pivotably coupled to the coupling mechanism using a pin and a plurality of synthetic washers, the synthetic washers disposed between each of the two side walls and the lower backboard support member, the lower backboard support member configured to move in conjunction with the movement of the screw jack, the first and second upper backboard support members configured to move in response to the movement of the lower backboard support member, the second segment having a slot configured to receive a member that enables a fixed height configuration, the pivot structure pivotably coupled to the lower backboard support member and the rim connection assembly, the pivot structure configured to enable a substantially constant overhang throughout the range of movement of the screw jack, the rim connection assembly comprising a support plate coupled to the backboard frame, a rim, and a plurality of tubular members through which portions of the rim are inserted and from which the rim is secured to the support plate, wherein the plurality of tubular members are configured to maintain a gap between the rim and the substrate, the first and second upper backboard support members rotatably coupled to peripheral edges of the backboard frame.

* * * * *